United States Patent [19]

Hart

[11] Patent Number: 4,750,900

[45] Date of Patent: Jun. 14, 1988

[54] QUICK DRAW MECHANISM FOR FIGURE TOY

[75] Inventor: William Hart, Palos Verdes Estates, Calif.

[73] Assignee: Mattel, Inc., Hawthorne, Calif.

[21] Appl. No.: 52,675

[22] Filed: May 20, 1987

[51] Int. Cl.[4] ..... A63H 13/04

[52] U.S. Cl. ..... 446/308; 446/336; 446/359

[58] Field of Search ..... 446/308, 309, 330, 336, 446/334, 359, 365, 298, 320, 335, 333

[56] References Cited

U.S. PATENT DOCUMENTS

| | | | |
|---|---|---|---|
| 3,082,573 | 3/1963 | Kantz | 446/298 |
| 3,699,713 | 10/1972 | Sapkus et al. . | |
| 3,911,616 | 10/1975 | Pelfrey | 446/333 |
| 3,947,994 | 4/1976 | Meyer et al. | 446/336 |
| 3,978,611 | 9/1976 | Strongin . | |
| 3,986,295 | 10/1976 | Keller . | |
| 4,003,158 | 1/1977 | Wolf et al. . | |
| 4,182,075 | 1/1980 | James . | |
| 4,279,099 | 7/1981 | Dyer et al. . | |

*Primary Examiner*—Mickey Yu

*Attorney, Agent, or Firm*—Ronald M. Goldman; Melvin A. Klein; Daniel F. Sullivan

[57] ABSTRACT

A quick drawing mechanism for use in an animated figure toy having a hollow torso and arm. A push button at the back of the torso is pushed causing a plate with rack to pivot and an arm connector having gears which engage the rack to rotate. Rotation of the arm connector causes the hollow arm to rotate upward and an upper member inside the arm to engage a stationary cam member mounted in the torso. The cam member causes the upper member to pivot which releases a lower member releasably held inside the hollow arm simulating a quick draw.

6 Claims, 3 Drawing Sheets

12
14
16
20
24
26
28
32
34
38
40
42
44
46
48
52
54
56
58
62
64
66
68
70
78
80
82
84
88
90

FIG 5
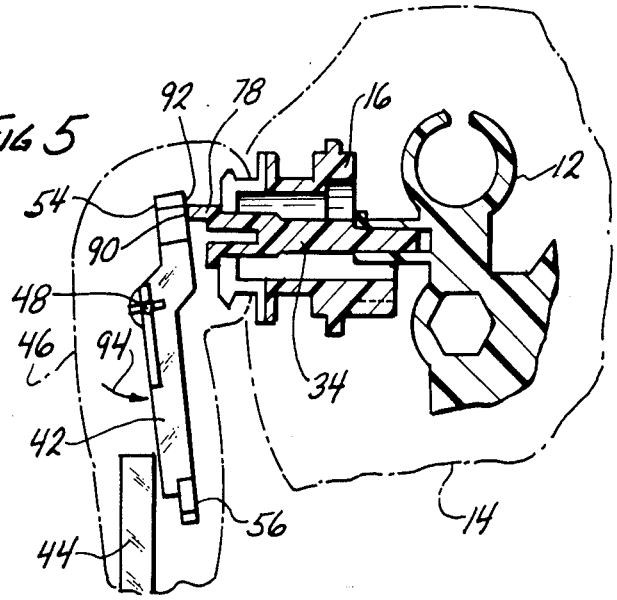
FIG 4
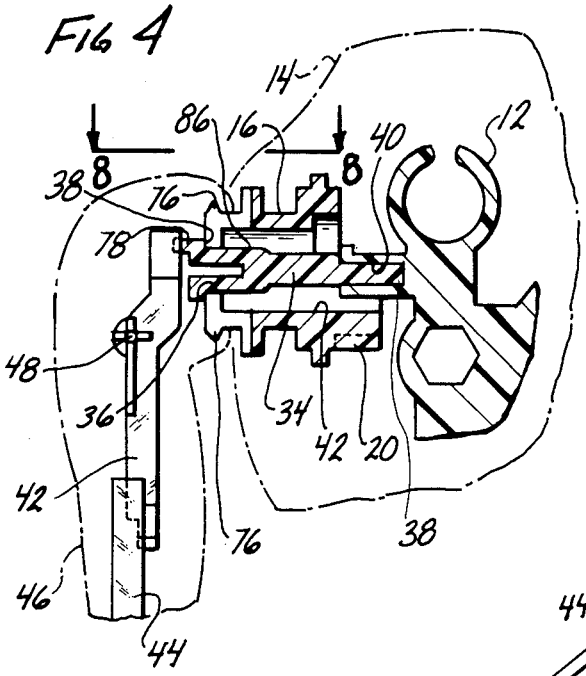
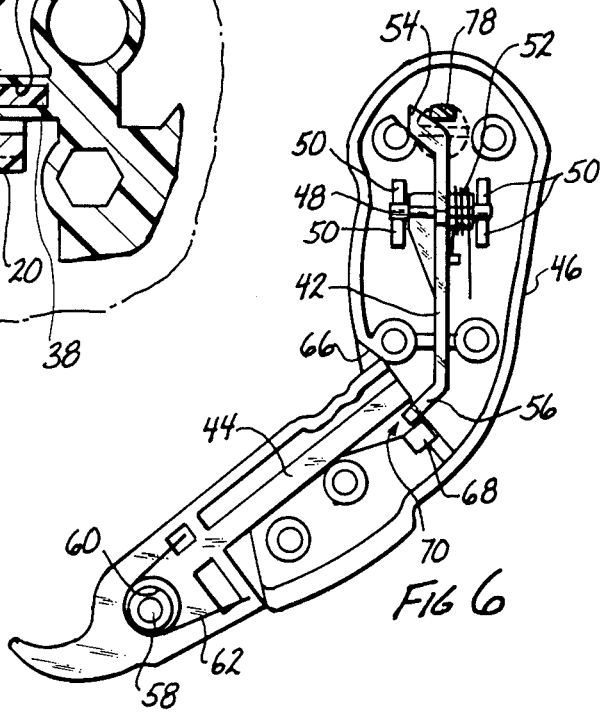
FIG 6

QUICK DRAW MECHANISM FOR FIGURE TOY

BACKGROUND OF THE INVENTION

The present invention relates generally to quick draw mechanisms used in figure toys and, more particularly, to a quick draw mechanism for a figure toy having a stationary cam member mounted at the shoulder of the figure which releases a pivotable member releasably held within a hollow arm of the figure.

In the past, a variety of figure toys with articulated appendages have been manufactured. For example, U.S. Pat. Nos. 4,182,075 and 3,978,611 disclose figure toys which provide quick draw play action. U.S. Pat. Nos. 4,003,158 and 3,699,713 describe figures with articulated arms which move up and down when a bottom is pushed. A telescoping arm for a toy figure is shown in U.S. Pat. No. 3,986,295. Finally, a shoulder assembly for a figure toy is described in U.S. Pat. No. 4,279,099 which is used to simulate the raising of a shoulder such as occurs during a shrug or a wave.

None of the above patents discloses a quick draw mechanism which uses a stationary cam member mounted at the shoulder of a figure toy which, upon actuation of a button, releases a pivotable member releasably held inside a hollow arm of the figure. Accordingly, there is a need in the toy manufacturing arts for such a mechanism.

SUMMARY OF THE INVENTION

It is an object of this invention to provide a quick draw mechanism for a figure toy which may be activated to release a pivotable member releasably held within a hollow arm of the figure.

It is another object of this invention to provide a quick draw mechanism for a figure toy which uses a stationary cam member mounted at the shoulder of the figure to release a lower pivotable member releasably held inside the arm of the figure.

It is still another object of this invention to provide a quick draw mechanism for a figure toy which has a lower pivotable member releasably held within the hollow arm of the figure by an upper pivotable member within the hollow arm which engages a cam member mounted at the shoulder of the figure.

These and other objects and advantages are obtained by a quick draw mechanism for use in an animated figure toy having a hollow torso and arm. A push button at the back of the torso is pushed causing a plate with rack to pivot and an arm connector having gears which engage the rack to rotate. Rotation of the arm connector causes the hollow arm to rotate upward and an upper member inside the arm to engage a stationary cam member mounted in which the torso releases a lower member releasably held inside the hollow arm simulating a quick draw.

The various features of the present invention will be best understood together with further objects and advantages by reference to the following description of the preferred embodiment taken in conjunction with the accompanying drawings.

BRIEF DESCRIPTION OF THE DRAWINGS

FIG. 4 is a partial cross-sectional view showing how a stationary cam member is mounted at the shoulder of the figure toy;

FIG. 5 is a partial cross-sectional view taken similar to FIG. 4 showing how the cam member engages an upper pivotable member within the hollow arm causing the pivotable member to rotate;

FIG. 6 is a partial cross-sectional view taken in the direction of arrows 6—6 shown in FIG. 1 showing a lower pivotable member releasably held within the hollow arm by the upper pivotable member;

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment although it should be understood that various modifications can be accomplished within the parameters of the present invention.

Figure 1:
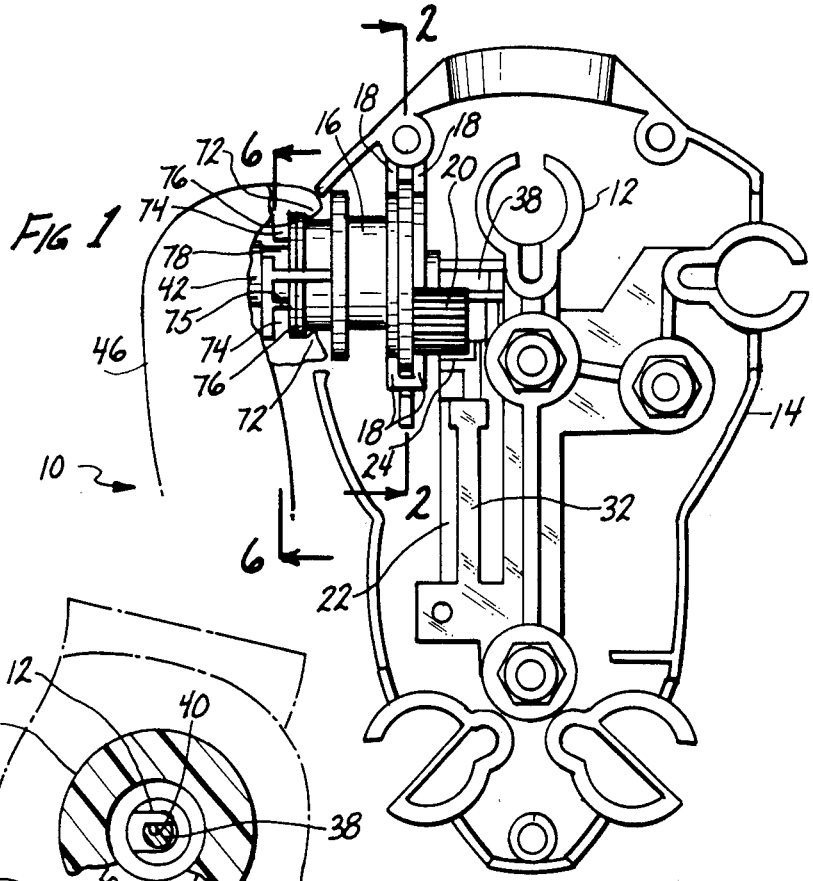
FIG. 1 is a front elevational view of an upper torso and hollow arm of a figure toy with the front portion of the torso removed and part of the arm broken away to show some of parts and gears used for the quick draw mechanism of the present invention.
Figure 2:
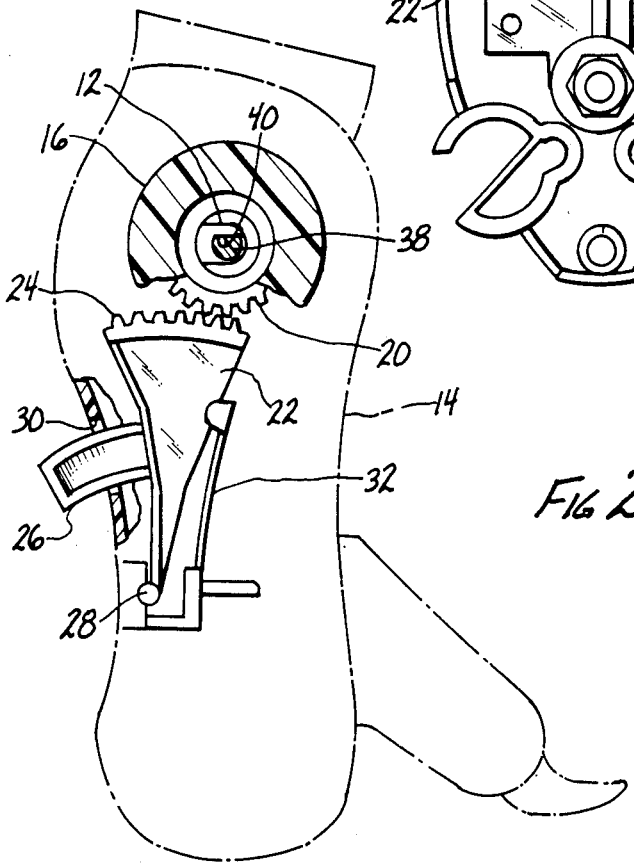
FIG. 2 is a partial cross-sectional view taken in the direction of arrows 2—2 shown in FIG. 1 showing how a plate with integral rack and push button is pivotally mounted inside the torso.

Referring now to the drawings and particularly to FIGS. 1, 2, 4 and 6, a preferred embodiment of the quick draw mechanism 10 of the present invention is disclosed. A supporting frame 12 is mounted inside an upper torso 14 of a figure toy. An arm connector 16 is rotatably mounted in the upper torso 14 using webs 18. The connector 16 has integral gears 20 near one end thereof. A plate 22 having a rack 24, push button 26 and pin 28 formed integrally thereto is pivotably mounted to torso 14 by pin 28. Push button 26 extends through aperture 30 in the back of torso 14. Referring to FIG. 2, spring 32 biases or forces plate 22 to the left and push button 26 outside torso 14. Rack 24 engages gears 20 of the arm connector 16 as best shown in FIG. 2.

Referring now to FIG. 4, a cam member 34 fits through aperture 36 at the end of connector 16 so that flange 38 at one end of member 34 rests on the end of the connector. The other end 38 of the cam member 34 preferably has a semicircular cross-section (see FIG. 2) which fits into aperture 40 in supporting frame 12. End 38 and aperture 40 are formed or shaped so that end 38 will not rotate in aperture 40. Any desirable shapes may be used for end 38 and aperture 40 so long as end 38 is prevented from rotating in aperture 40. As a result, cam member 34 will not rotate or remains stationary with respect to the supporting frame 12. Note that arm connector 16 has internal bore 42 which provides room for member 34 and support 12.

FIG. 6 shows upper and lower pivotable members 42 and 44, respectively, pivotably mounted within a hollow arm 46 of the figure toy. Member 42 is pivotably mounted in arm 46 by integral pin 48 which rotatably engages apertures in webs 50 attached to arm 46. Spring 52 surrounds pin 48 and is mounted to member 42 and arm 46 so that it biases or forces end 54 of member 42 toward arm connector 16 while end 56 is forced away from connector 16 or torso 14. Member 44 is pivotably mounted to boss 58 of arm 46. Boss 58 rotatably engages aperture 60 in member 44. Spring 62 surrounds boss 58 and is mounted to member 42 and arm 46 so that it biases member 44 in the direction of arrow 64 shown in FIG. 7.

Hollow arm 46 has an elongated slot 66 therein. As such, member 44 may be manually rotated about boss 58 against the force of spring 62 until it is pushed through slot 66 and inside the hollow arm 46. As member 44 is pushed inside arm 46, protuberance 68 at one end of member 44 slides past end 56 causing member 42 to pivot against the force of spring 52 until end 56 engages groove 70 in member 44. As a result, member 44 is held inside arm 46 by end 56 of member 42 which releasably engages groove 70.

As shown in FIG. 1, arm 46 has flanges 72 and 74. Likewise, arm connector 16 has flanges 76. As such, arm 46 may be connected to torso 14 by pushing arm 46 and connector 16 together until flanges 72, 74 and 76 operably engage each other as shown in FIG. 1. Note that flange 74 has aperture 75 passing therethrough.

Figures 3, 7, 8:
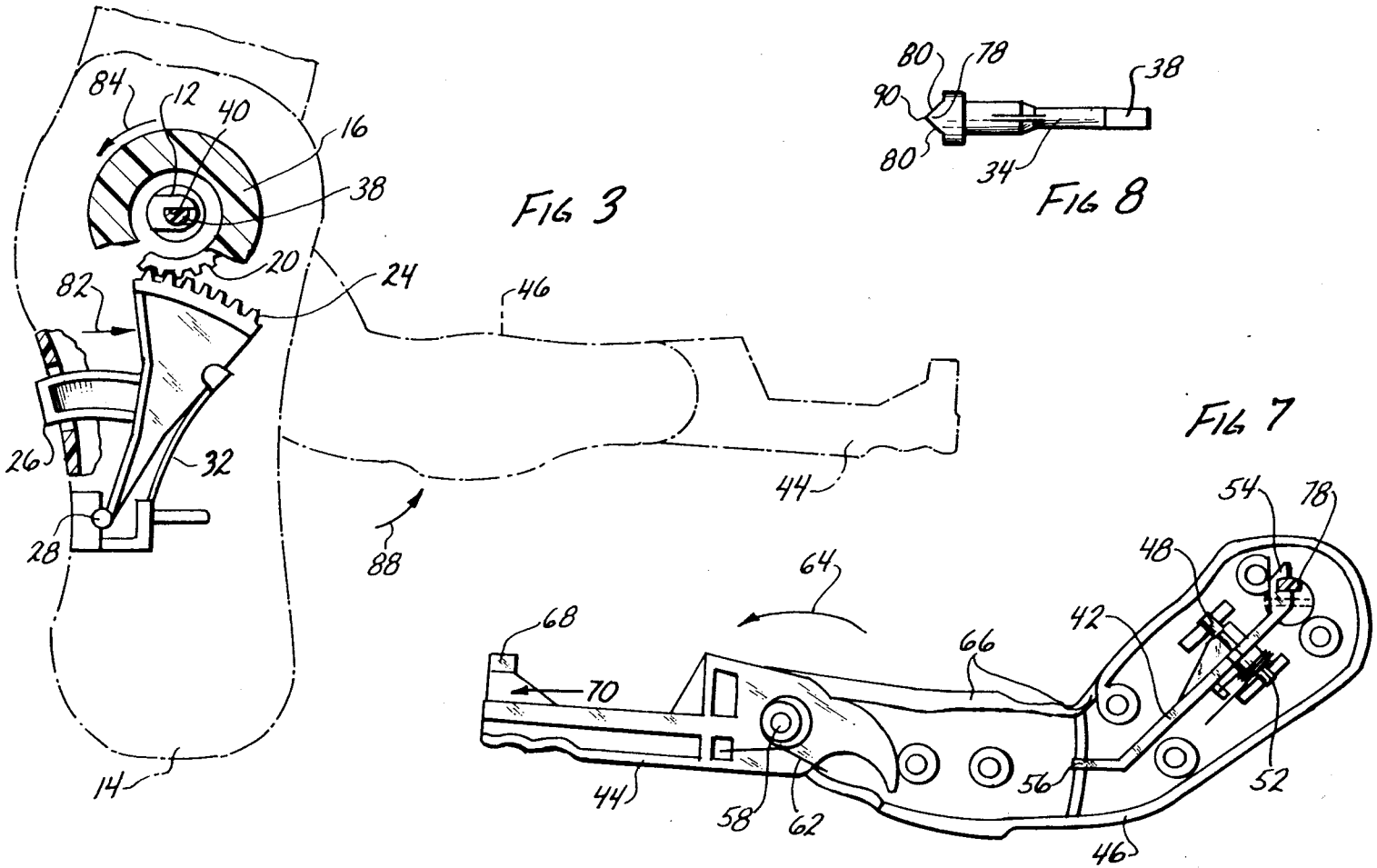
FIG. 3 is a partial cross-sectional view taken in the same direction as FIG. 2 showing how the push button activates the quick draw mechanism.
FIG. 7 is a partial cross-sectional view taken similar to FIG. 6 showing how the lower pivotable member is released after the quick draw mechanism is activated by the push button as shown in FIG. 3.
FIG. 8 is a top plan view of the cam member taken in the direction of arrows 8—8 shown in FIG. 4.

Referring now to FIG. 8, cam member 34 has a cam extension 78 at one end thereof with slanted slides 80. When end 38 of member 34 is inserted into aperture 40 in frame 12 as shown in FIG. 4 and arm 46 is connected to torso 14, cam extension 78 passes through aperture 75 as shown in FIG. 1 and is orientated with respect to end 54 of upper member 42 as shown in FIGS. 4 and 6. Note that arm 46 is installed in the position shown in FIGS. 4 and 6 during manufacturing and is orientated in this position before push button 26 activates the quick draw mechanism 10.

The quick draw mechanism works as described below. First, a child pushes member 44 inside arm 46 until end 56 of member 42 engages groove 70 of member 44. When in this position member 44 is releasably held inside hollow arm 46. Then, push button 26 is pushed. This causes plate 22 to pivot about pin 28 in the direction of arrow 82 as illustrated in FIG. 3. Since rack 24 is engaged to gears 20, arm connector 16 is caused to rotate in the direction of arrow 84 as shown in FIG. 3. During this time, cam member 34 remains stationary since end 38 will not rotate in aperture 40. However, clearance between aperture 36 of arm connector 16 and outside diameter 86 (see FIG. 4) of cam member 34 allows connector 16 to rotate about member 34. Rotation of the arm connector 16 causes arm 46 to rotate upward in the directon of arrow 88 as illustrated in FIG. 3.

As arm 46 rotates, end 54 of member 42 comes into contact with slanted sides 80 of stationary cam extension 78. Continued rotation of the arm 46 causes end 54 to slide past slanted sides 80 and pointed edge 90 of cam extension 78 to contact surface 92 of end 54 resulting in pivoting of member 42 about pin 48 in the direction of arrow 94 as illustrated in FIG. 5. As member 42 moves in the direction of arrow 94, end 56 disengages from groove 70 in member 44. After end 56 disengages, spring 62 causes member 44 to rotate in the direction of arrow 64 shown in FIG. 7. As a result, a quick draw is simulated as arm 46 moves upward and member 44 is released from inside the arm.

When the push button 26 is released, spring 32 causes arm 46 to return to the position shown in FIG. 6. Member 44 can then be pushed inside hollow arm 46 and the quick draw mechanism 10 can be activated once again by pushing button 26.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

I claim:

1. A quick draw mechanism for use in an animated figure toy having a hollow torso and a hollow arm comprising:

means mounted inside said hollow torso and coupled to said hollow arm for rotating said hollow arm;

an upper member pivotally mounted inside said hollow arm;

a lower member pivotally mounted to said hollow arm and capable of releasably engaging said upper member inside said hollow arm;

first spring means for biasing said lower member outside said hollow arm;

second spring means for biasing said upper member into engagement with said lower member in order to releasably hold said lower member inside said hollow arm; and stationary cam member means mounted to said hollow torso for pivoting said upper member in order to disengage said upper member from said lower member.

2. The quick draw mechanism of claim 1 wherein said rotating means includes:

a plate having a push button and rack;

an arm connector rotatably mounted to said hollow torso and connected to said hollow arm, said arm connector having gears engaging said rack; and third spring means for returning said hollow arm to an original position after rotation thereof.

3. The quick draw mechanism of claim 2 wherein said hollow arm has an elongated slot therein and said lower member is capable of passing through said slot.

4. The quick draw mechainsm of claim 3 wherein said cam member means includes a cam extension having slanted sides.

5. A quick draw mechanism of claim 4 wherein said upper member is capable of releasably engaging a groove in said lower member.

6. A quick draw mechanism for use in an animated figure toy having a hollow torso and a hollow arm comprising:

a plate inside said torso having a rack and push button formed integrally thereon, said plate pivotally engaging said torso, said push button extending outside said torso through an aperture in said torso;

an arm connector rotatably mounted inside said torso and connected to said hollow arm, said connector having an aperture at one end thereof and gears engaging said rack;

an upper member pivotally mounted inside said hollow arm;

a lower member pivotably mounted to said hollow arm and capable of releasably engaging said upper member inside said hollow arm, said lower member being capable of passing through an elongated slot in said hollow arm;

first spring means for biasing said lower member outside said hollow arm;

second spring means for biasing said upper member into engagement with said lower member in order to releasably hold said lower member inside said hollow arm; and stationary cam member means mounted to said hollow torso for pivoting said upper member in order to disengage said upper member from said lower member, said cam member means including a cam extension extending through said aperture in said arm connector, said cam extension being capable of engaging said upper member.

* * * * *